US009500403B2

(12) United States Patent
Seo et al.

(10) Patent No.: US 9,500,403 B2
(45) Date of Patent: Nov. 22, 2016

(54) REFRIGERATOR WITH BASKET FRAME LATCHED TO THE REFRIGERATOR DOOR

(71) Applicant: LG ELECTRONICS INC., Seoul (KR)

(72) Inventors: Woonkyu Seo, Changwon-si (KR); Seonkyu Kim, Changwon-si (KR); Seungjin Yoon, Changwon-si (KR); Jungyeon Hwang, Changwon-si (KR); Daesung Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 640 days.

(21) Appl. No.: 13/656,934

(22) Filed: Oct. 22, 2012

(65) Prior Publication Data

US 2013/0104590 A1 May 2, 2013

(30) Foreign Application Priority Data

Oct. 26, 2011 (KR) ..... 10-2011-0109799

(51) Int. Cl.
*F25D 25/00* (2006.01)
*F25D 23/04* (2006.01)

(52) U.S. Cl.
CPC ..... *F25D 23/04* (2013.01)

(58) Field of Classification Search
CPC ..... F25D 23/04
See application file for complete search history.

(56) References Cited

U.S. PATENT DOCUMENTS 1,927,398 A * 9/1933 Glasser ..... F25D 23/04 62/377
3,086,830 A * 4/1963 Malia ..... 312/200
5,685,624 A * 11/1997 Lee ..... F25D 23/04 312/274
6,085,542 A 7/2000 Johnson et al.
9,175,901 B2 * 11/2015 Oh ..... F25D 23/02
2006/0090496 A1 * 5/2006 Adamski et al. ..... 62/344
2011/0146324 A1 * 6/2011 Lee et al. ..... 62/344

FOREIGN PATENT DOCUMENTS

CN 1475748 A 2/2004
CN 1880901 A 12/2006
CN 1940432 A 4/2007
CN 201173659 Y 12/2008
DE 102004045476 A1 * 3/2006 ..... F25D 23/08
FR 793124 A * 1/1936 ..... F25D 17/04
FR 1347720 A * 1/1964 ..... F25D 23/04

(Continued)

OTHER PUBLICATIONS

Machine Translation of Detailed Description DE102004045476—retreived on Jun. 2015.*

(Continued)

*Primary Examiner* — Len Tran
*Assistant Examiner* — Orlando Aviles Bosques
(74) *Attorney, Agent, or Firm* — Ked & Associates, LLP

(57) ABSTRACT

A refrigerator is provided. The refrigerator may include a case having a storage space formed therein and being opened at one side, a door rotatably coupled to the case to open and close the opened side of the case, and a basket frame rotatably coupled to an inner surface of the door. A first basket may be coupled to the basket frame, opposing the door, and a second basket may be coupled to the inner surface of the door, interposed between the door and the basket frame. The first basket may rotate in accordance with pivotal movement of the basket frame to expose and provide access to an interior of the second basket.

16 Claims, 12 Drawing Sheets

(56) References Cited

FOREIGN PATENT DOCUMENTS

| | | | | |
|---|---|---|---|---|
| JP | 11-230541 | | 8/1999 | |
| JP | 2001-056176 | | 2/2001 | |
| JP | 2002-090055 | A | 3/2002 | |
| JP | 2002090055 | A * | 3/2002 | ..... F25D 25/02 |
| KR | 0136407 | B1 | 7/1998 | |
| KR | 10-2004-0063467 | | 7/2004 | |

OTHER PUBLICATIONS

Chinese Office Action dated Jul. 2, 2014 issued in Application No. 201210417463.9 (with English translation).

* cited by examiner

REFRIGERATOR WITH BASKET FRAME LATCHED TO THE REFRIGERATOR DOOR

CROSS-REFERENCE TO RELATED APPLICATION(S)

This application claims priority under 35 U.S.C. §119 to Korean Patent Application No. 10-2011-0109799, filed on Oct. 26, 2011, whose entire disclosure is hereby incorporated by reference.

BACKGROUND

1. Field

This relates to a refrigerator.

2. Background

Generally, a refrigerator stores items in a frozen or refrigerated state by lowering an internal temperature of a compartment thereof through discharge of cold air generated by a refrigeration cycle including a compressor, a condenser, and an expansion valve, and an evaporator. Such a refrigerator may include a freezing compartment for storing items in a frozen state, and a refrigerating compartment for storing items at low temperature. A Kimchi refrigerator may store items such as Kimchi or vegetables in a fresh state.

A refrigerator may include a plurality of doors, at least one of the plurality of doors being connected to a refrigerator body by hinges to open or close a front side of the refrigerator body. In addition to the hinged door, the refrigerator may include a drawer type door mounted to a front wall of a drawer slidably installed in the refrigerator. Items of various sizes and shapes may be stored in the freezing and refrigerating compartments, which may include a plurality of racks to vertically partition the storage compartment to receive such items. One or more baskets may be attached to a refrigerator door and/or a freezer door to store frequently used items.

BRIEF DESCRIPTION OF THE DRAWINGS

The embodiments will be described in detail with reference to the following drawings in which like reference numerals refer to like elements wherein.

DETAILED DESCRIPTION

Figure 1:
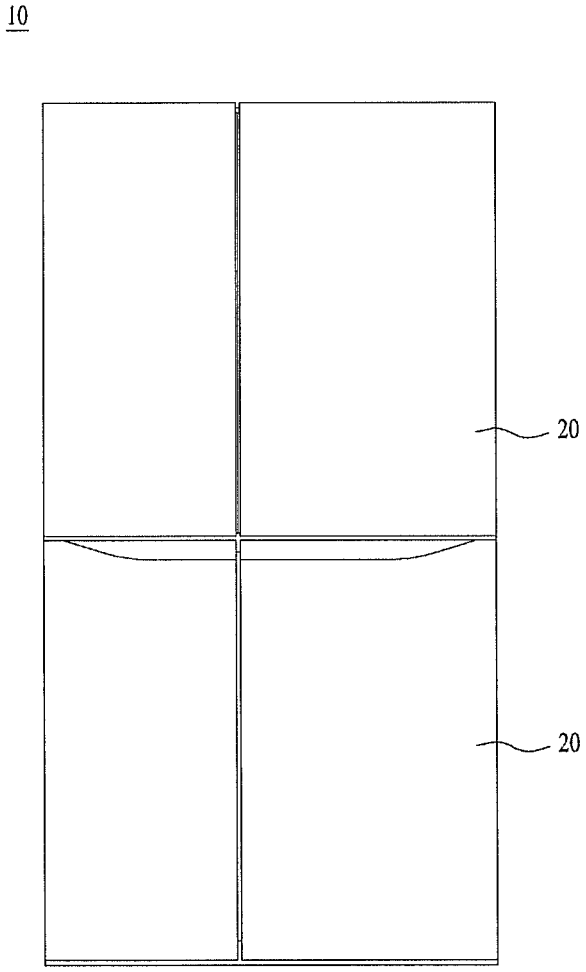
FIG. 1 is a front view of a refrigerator according to an exemplary embodiment as broadly described herein.

Reference will now be made in detail to the preferred embodiments of the present invention, examples of which are illustrated in the accompanying drawings.

In accordance with exemplary embodiments as broadly described herein, the refrigerator, which is designated by reference numeral "10" in the accompanying drawings, may apply not only to a top mount type refrigerator in which the inner space of the refrigerator is vertically partitioned to define a freezing compartment and a refrigerating compartment such that the freezing compartment is arranged above the refrigerating compartment, but also to a side-by-side type refrigerator in which the inner space of the refrigerator is laterally partitioned to define a freezing compartment and a refrigerating compartment such that the freezing compartment and refrigerating compartment are laterally arranged, and to a bottom freezer type refrigerator in which the freezing compartment is arranged below the refrigerating compartment.

However, simply for ease of discussion and illustration embodiments will be described in conjunction with a bottom freezer type refrigerator. That is, for purposes of discussion, the inner space of the refrigerator 10 is vertically partitioned to define a freezing compartment 32 arranged below the refrigerating compartment 22.

Generally, the freezing compartment 32 may maintain storage items at a sub-zero temperature, and the refrigerating compartment 22 may maintain storage items at a temperature relatively higher than that of the freezing compartment 32.

The refrigerator 10 may include a body which defines an outer appearance of the refrigerator 10 while also protecting mechanical devices received therein. The body of the refrigerator 10 may include an outer case 12 which defines an outer appearance of the refrigerator 10, and an inner case 14 which defines storage compartments therein, namely, the freezing compartment 32 and refrigerating compartment 22. A certain space may be defined between the outer case 12 and the inner case 14. A passage for circulation of cold air may be formed in the space.

A machinery chamber may be formed in the space between the outer case 12 and the inner case 14 to accommodate a refrigerant cycle device for generating cold air through circulation of a refrigerant. Using the refrigerant cycle device, the interior of the refrigerator 10 may be maintained at low temperature to keep a desired freshness level of items stored in the refrigerator 10. The refrigerant cycle device may include a compressor for compressing a refrigerant, and an evaporator for changing the phase of the refrigerant from liquid to gas, to cause the refrigerant to exchange heat with the outside of the refrigerant cycle device.

The refrigerator 10 may include doors 20 for opening or closing the freezing compartment 32 and refrigerating compartment 22, respectively. Each door 20 may be pivotally mounted to the body of the refrigerator 10 at one end thereof by hinges. Each door 20 may include a plurality of doors. That is, as shown in FIG. 2, each door 20 may be configured such that it opens forward while being pivotally moved about opposite lateral edges of the refrigerator 10.

A barrier 16 may be positioned between the freezing compartment 32 and the refrigerating compartment 22, to partition the freezing compartment 32 and refrigerating compartment 22. The barrier 16 may be formed at the inner case 14 such that it has a certain thickness. The barrier 16 may extend horizontally to vertically partition the freezing compartment 32 and refrigerating compartment 22 such that the freezing compartment 32 and refrigerating compartment 22 are disposed below and above the barrier 16, respectively.

A partition wall 18 may be positioned in the freezing compartment 32, for example at a central portion thereof, to partition the freezing compartment 32 into two separate spaces. The partition wall 18 may be vertically installed at the inner case 14 such that the freezing compartment 32 is divided into two laterally arranged compartments. In this case, the door 20 for the freezing compartments 32 may include two doors for opening or closing respective freezing compartments 32.

Figure 2:
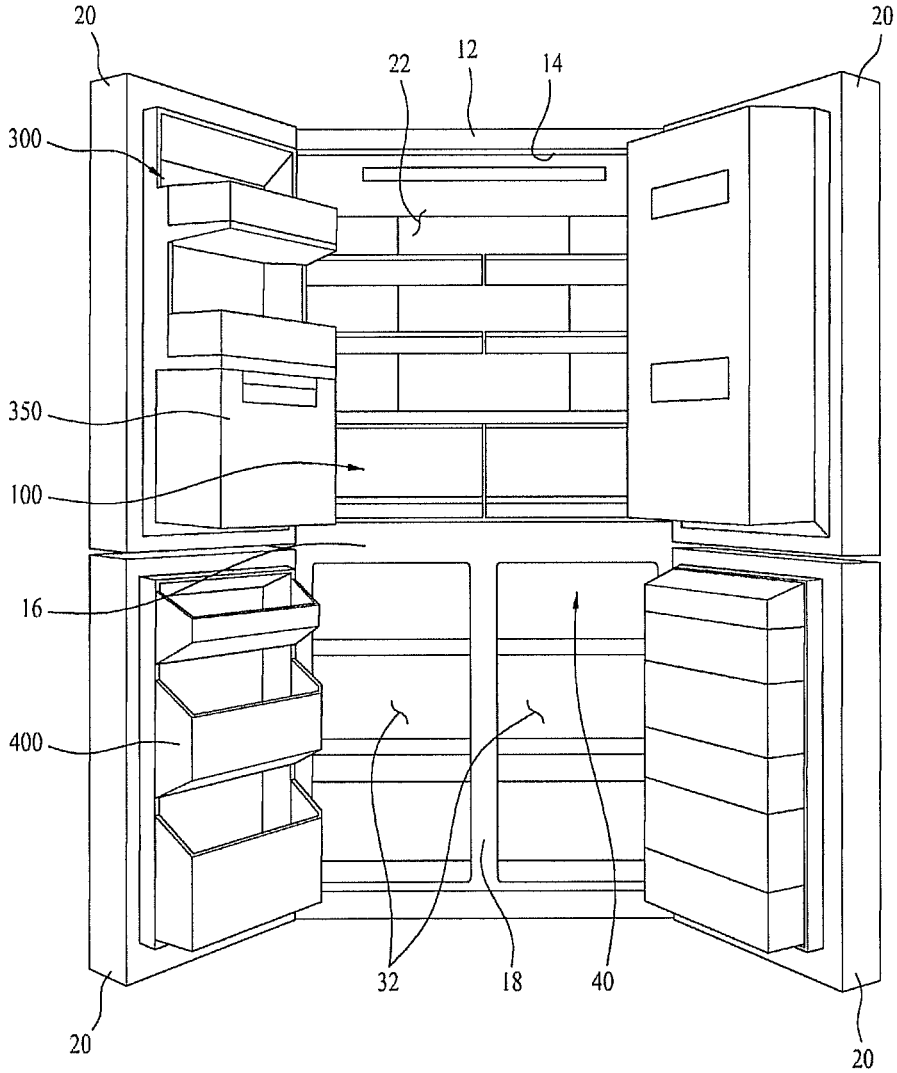
FIG. 2 is a front view of the refrigerator shown in FIG. 1, with its doors open.

In the embodiment shown in FIGS. 1 and 2, there is no partition wall installed in the refrigerating compartment 22 to laterally partition the refrigerating compartment 22. However, a partition wall may be installed in the refrigerating compartment 22, as in the freezing compartment 32.

Baskets 300, 350 and 400 may be provided at the doors 20. Each of the baskets 300, 350 and 400 may have a relatively large storage capacity corresponding to a relatively increased refrigerator capacity and provide for easy access thereto. The baskets 300, 350 and 400 may have various shapes and/or sizes in order to enhance utility thereof.

The baskets may be classified into three kinds of baskets. For example, the basket 300 may store relatively thin items, such as, for example, beverages stored in bottles or other items contained in tubular containers, which may be positioned vertically upright in multiple layers from an inside to an outside of the basket 300, and which may be separable to allow items stored in the inside of the basket 300 to be easily taken out. The basket 350 may be a sealable or closeable basket for storing, for example, vegetables. The basket 400 may be a relatively large-capacity basket, and may have a variable storage capacity.

Figure 3:
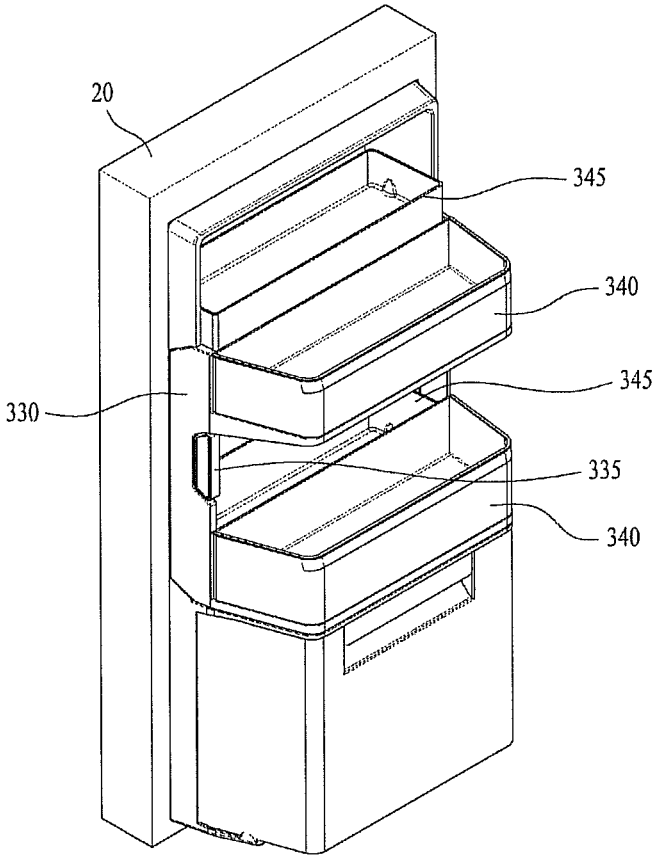
FIGS. 3 and 4 are perspective views of a door and a basket frame of the exemplary refrigerator shown in FIGS. 1 and 2, according to an embodiment as broadly described herein.
Figure 4:
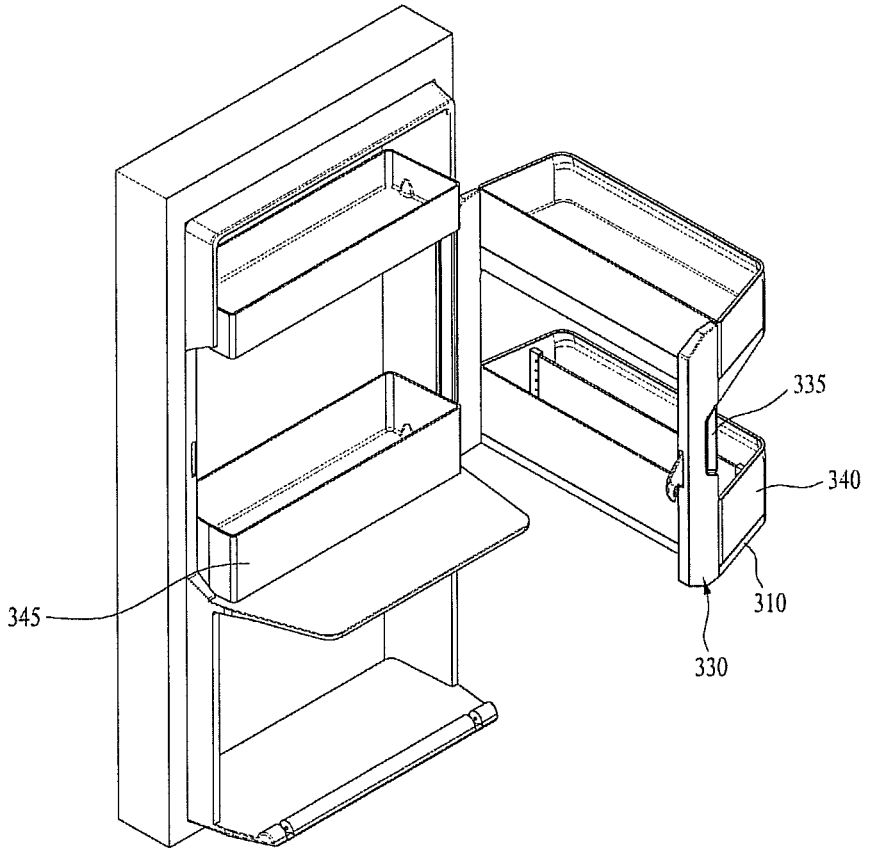

FIGS. 3 and 4 are perspective views of one of the refrigerator doors 20 having a basket frame 330, first baskets 340, second baskets 345, and a locker 335 provided thereon.

As described above, one edge of the door 20 may be pivotally coupled to a body of the refrigerator 10 such that it is pivotable about the body of the refrigerator 10. An inside of the door 20 may include a storage space to store frequently used items to be stored in an upright state.

The basket frame 330 may be pivotally coupled, at one end thereof, to an inner surface of the door 20 by, for example, hinges, such that it is pivotable with respect to the door 20. Baskets may be horizontally arranged on the door 20. For example, the first baskets 340 may be arranged in an outer layer, and the second baskets 345 may be arranged in an inner layer, between the door 20 and the first baskets 340, as shown in FIG. 3. The basket frame 330 may be provided to facilitate facilitate storage of items in the second baskets 345. That is, the first baskets 340 may be mounted on the basket frame 330 spaced apart from and opposing the door 20, and the second baskets 345 may be positioned between the basket frame 330 and the door 20.

To access one of the second baskets 345, the user may pivot the basket frame 330 about the hinges as shown in FIG. 4 such that the first baskets 340 are spaced apart from the second baskets 345, thereby exposing the second baskets 345. When the basket frame 330 is open, access to the second baskets 345 may be enhanced.

The second baskets 345 may be used to store lower frequency items than those stored in the first baskets 340. Thus, the basket frame 330 may be selectively fixed to the door 20 by a locker 335 provided at a position opposite the hinges coupling the basket frame 330 to the door 20, to prevent the basket frame 330 from unintentional pivoting.

Figure 5:
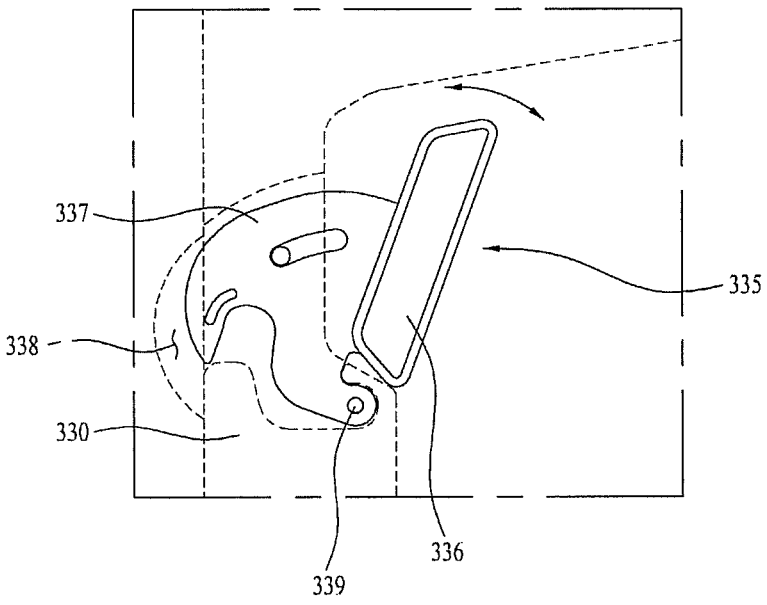
FIG. 5 is illustrates an unlocking state of a locker of the basket frame shown in FIGS. 3 and 4.
Figure 6:
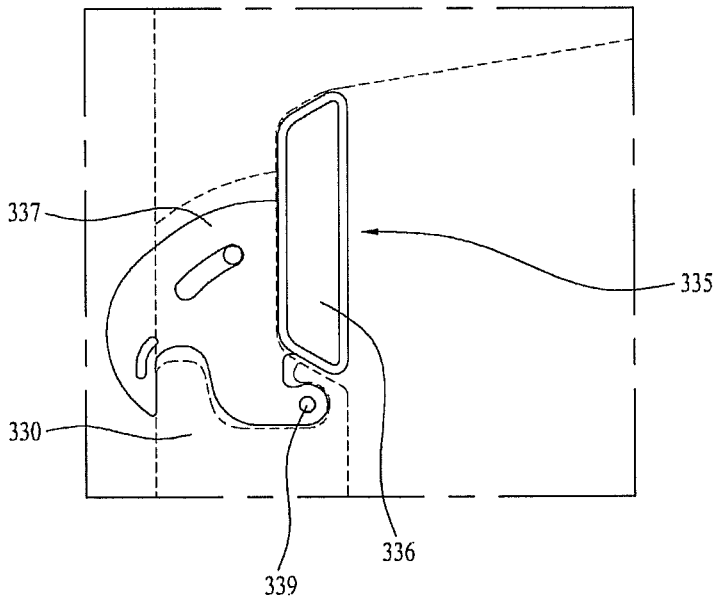
FIG. 6 is illustrates a locked state of the locker of the basket frame shown in FIGS. 3 and 4.

FIG. 5 illustrates an unlocking state of the locker 335 and FIG. 6 illustrates a locking state of the locker 335. The locker 335 may include a lever 336 and a hook 337. The lever 336 may be pivotally coupled, at one end thereof, to the basket frame 330 by a hinge 339 such that it pivots about the hinge 339 in response to a force applied at the other end of the lever 336.

The hook 337 may be coupled, at one end thereof, to the lever 336. As the lever 336 rotates, the other end of the hook 337 may be engaged with a locking groove 338 provided at the door 20, thereby fixing the basket from 330 to the door 20 and preventing the basket frame 330 from rotating. To open the basket frame 330, the user may pivot the lever 336 in a direction opposite to a locking direction such that the end of the hook 337 is disengaged from the locking groove 338 of the door 20, releasing the basket frame 330 from the door 20 and allowing movement of the basket frame 330.

Figure 7:
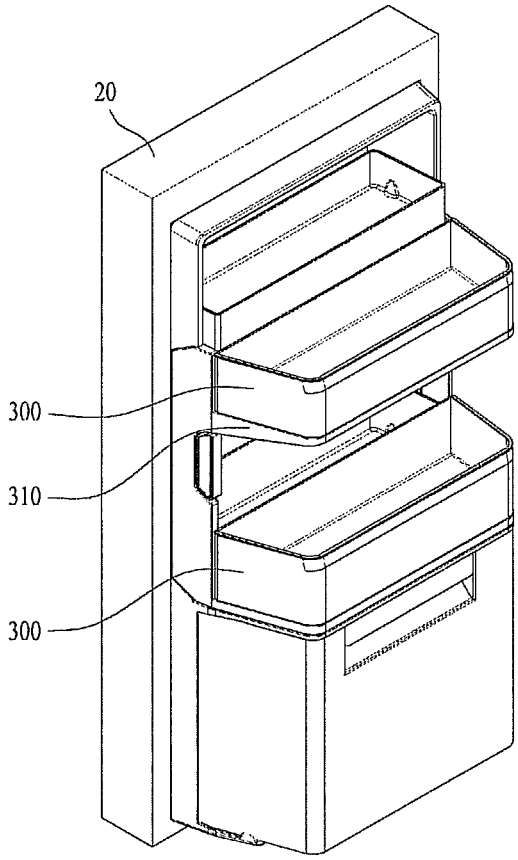
FIGS. 7 and 8 are perspective views of a door and a basket frame of the exemplary refrigerator shown in FIGS. 1 and 2, according to another embodiment as broadly described herein.

The first baskets 340, which are coupled to the basket frame 330, may be formed integrally with the basket frame 330. Alternatively, each first basket 340 may be a separable basket, such as, for example, the basket 300, which is separably coupled to a door rack 310, as shown in FIG. 7.

Each door rack 310 may protrude from the inner surface of the door 20 and have a flat plate shape to allow an article to be stored thereon. However, as the door rack 310 has an opened periphery, the article stored on the door rack 310 may fall when the door 20 is moved.

To this end, the separable basket 300 may be separably mounted on an upper surface of the door rack 310 to enclose the periphery of the door rack 310. The separable basket 300 may have an upwardly-opened box structure which may be separably mounted on the door rack 310. The separable baskets 300 may have various heights in accordance with a particular purpose thereof. For example, the separable baskets 300 shown in FIG. 7 have a relatively low height to allow items, such as bottled food articles or milk products, which are stored in an upright state, to be easily stored in or removed from the separable basket 300.

The separable basket 300 does not necessarily have the same bottom shape as the door rack 310. However, the separable basket 300 may be more stably seated on the door rack 310 when it has the same shape as the door rack 310. The separable basket 300 may be coupled to the door rack 310 without any appreciable protruded or recessed portions to minimize unintended separation of the separable basket 300 from the door rack 310 due to impact applied to the separable basket 300 at such a protruded portion.

When the separable basket 300 is positioned on the door rack 310, it may be unintentionally separated from the door rack 310 during opening or closing of the door 20. To this end, a holder may be provided to prevent unintentional separation of the separable basket 300 from the door rack 310.

In one embodiment, such a holder may include a first protrusion/groove structure 301 formed at an outer bottom surface of the separable basket 300, and a second protrusion/groove structure 311 formed on an upper surface of the door rack 310 such that the second protrusion/groove structure 311 is engagable with the first protrusion/groove structure 301 when the separable basket 300 is positioned on the door rack 310. When the first and second protrusion/groove structures 301 and 311 have opposite protrusion/groove arrangements, they may be coupled in accordance with engagement between protrusions and grooves, and may resist horizontal force applied thereto during opening or closing of the door 20 to maintain the separable basket 300 in position on the door rack 310.

Figure 8:
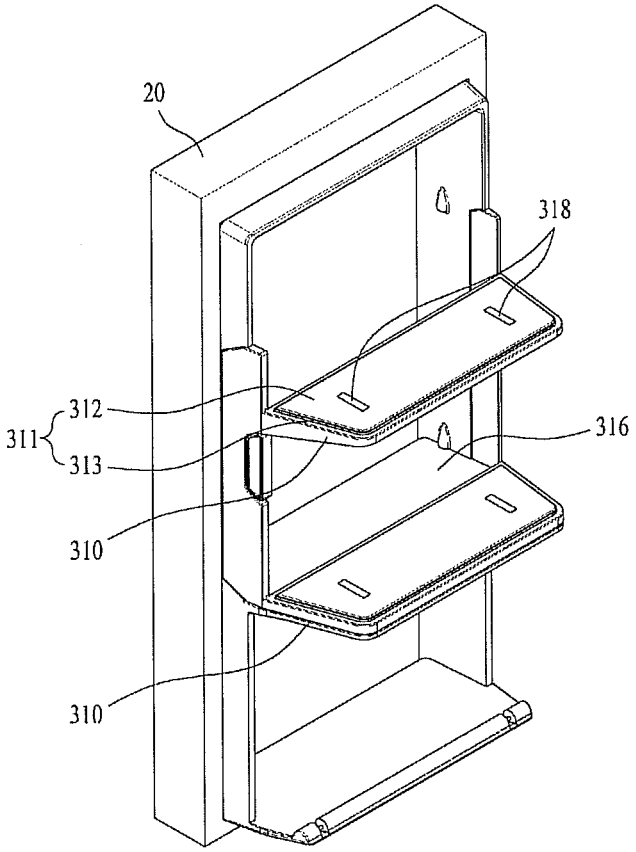
Figure 9:
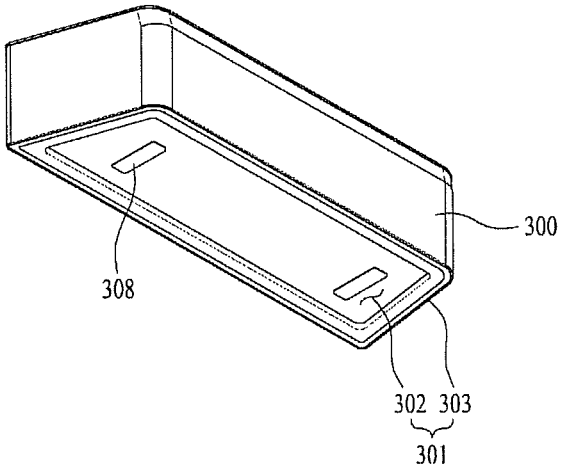
FIG. 9 is a perspective view of a door basket, according to an embodiment as broadly described herein.

FIGS. 8 and 9 illustrate separated states of the door rack 310 and separable basket 300, respectively. As shown in FIG. 9, the first protrusion/groove structure 301 may include a first protrusion 303 extending downward from the lower surface of the bottom of the separable basket 300, for example, along the periphery of the bottom of the separable basket 300, and a first groove 302 adjacent to the first protrusion 303, surrounded by the first protrusion 303. The second protrusion/groove structure 311, which corresponds to the first protrusion/groove structure 301, may include a second protrusion 312, which is to be fitted in the first groove 303, as shown in FIG. 8. In order to achieve more stable coupling of the separable basket 300 to the door rack 310, the second protrusion/groove structure 311 may also include a second grove 313, in which the first protrusion 302 is to be received.

In alternative embodiments, the first and second protrusion/groove structures 301 and 311 may not necessarily each include both the groove and the protrusion. For example, one of the first or second protrusion/groove structure 301/311 may include a groove, and the other of the first or second protrusion/groove structure 301/311 may include a protrusion to be fitted in the groove. Such an arrangement may resist lateral force in accordance with engagement between the groove and the protrusion and maintain coupling the separable basket 300 and the door rack 310, irrespective of opening or closing of the door 20. Further, such engagable protrusions and grooves may be formed at other locations in addition to or instead of the periphery as shown.

In another embodiment, the holder may include first and second magnets 308 and 318 which couple the separable basket 300 and door rack 310 by magnetic force. The first magnets 308 may be provided at the lower surface of the bottom of the separable basket 300, and the second magnets 318 may be provided at the upper surface of the door rack 310 to be coupled in accordance with attractive forces thereof.

Referring to FIGS. 8 and 9, the magnets 308 and 318 may be provided at positions facing each other when the separable basket 300 is seated on the door rack 310. The size and number of the magnets may be varied, and not limited to those of FIG. 9.

In certain embodiments, magnets may be provided at only one of the separable basket 300 or the door rack 310, while providing a metal plate at the other of the separable basket 300 or the door rack 310, such that the metal plate is coupled to the magnets by attractive force. That is, the separable basket 300 may be held on the door rack 310 by providing the first magnets 308 at the lower surface of the bottom of the separable basket 300, and providing a second metal plate at the upper surface of the door rack 310 such that the second metal plate is coupled to the first magnets 308 by attractive force of the first magnets 308.

Alternatively, the separable basket 300 may be held on the door rack 310 in a manner opposite to the above-described manner by providing the second magnets 318 at the upper surface of the door rack 310, and providing a first metal plate at the lower surface of the bottom of the separable basket 300 such that the first metal plate is coupled to the second magnets 318 by attractive force of the second magnets 318.

Each of the first metal plate and second metal plate may partially cover the surface at which it is provided, as in the first magnets 308 and second magnets 318. Alternatively, the entire lower surface of the bottom of the separable basket 300 or the entire upper surface of the door rack 310 may be made of metal.

Additionally, as shown in FIG. 8, a second door rack 316 may be provided adjacent to the inner surface of the door 20, and the second basket 345 shown in FIGS. 3 and 4 may be separably coupled to an upper surface of the second door rack 316.

Hereinafter, a partition plate 320 provided at a basket 315 will be described with reference to FIGS. 10-13.

Figure 10:
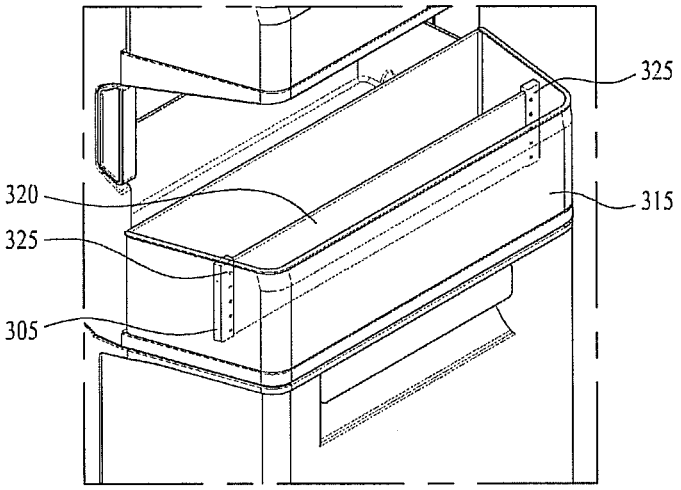
FIG. 10 is a perspective view of a partition plate, according to an embodiment as broadly described herein.

The basket 315 shown in FIG. 10 may include any one of the movable basket 300, the first basket 340 or the second basket 345. The basket 315 may include any storage space, which is upwardly opened while having a box shape, to store items therein.

In particular, since the basket 315, which is attached to the refrigerator door 200, allows an item contained in a container having a relatively small thickness, for example, a bottle or a tube, to be stored in an upright state, utility of the basket 315 may be enhanced by a partition plate 320 positioned therein.

When relatively small bottles are stored in the relatively large basket 315, the bottles may move during opening or closing of the door 20. To this end, the partition plate 320 may be installed at the basket 315 and may be made of a flexible material to provide for flexibility in accommodating storage items of various sizes.

For example, the partition 320 may be made a material having deformability and elasticity such that an original shape thereof may be restored, and that may hold food articles stored in the basket 315. For example, silicon may be used as the flexible material.

When the partition plate 320 is made of a hard/rigid material such as plastic, it may be difficult to accommodate an item having a large size, thus reducing the storage capacity of the basket 315 due to the partition plate 320. However, when the partition plate 320 is made of a flexible material, items having various sizes may be accommodated in the basket 315 because the partition plate 320 is deformable in response to the sizes and shapes of the stored items. The flexible partition plate 320 may also provide for easy arrangement of the storage items in the basket 315.

As shown in FIG. 10, the partition plate 320 may be installed at a middle portion of the basket 315 by coupler provided at opposite ends thereof. The couplers may be integrated with the basket 315. Alternatively, the couplers may have a separable structure, to change coupling positions thereof in accordance with the size of an item to be stored in the basket 315. Separable coupling of the couplers may be implemented in various manners using, for example, a forcible fitting method, a latching structure, and other arrangements as appropriate. In the illustrated embodiment, separable coupling of the couplers is achieved using a sliding engagement between the partition plate 320 and the basket 315.

Figure 11:
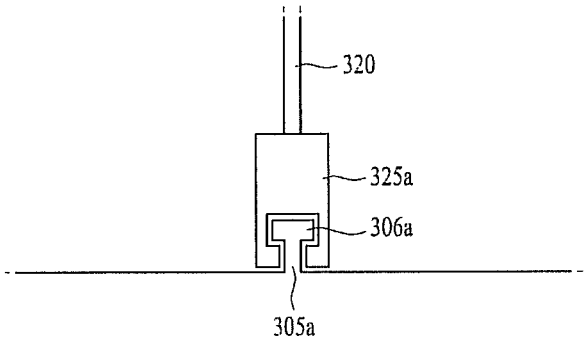
FIGS. 11 to 13 are plan views of couplers of the door basket and the partition plate shown in FIGS. 9 and 10, according to an embodiment as broadly described herein.
Figure 12:
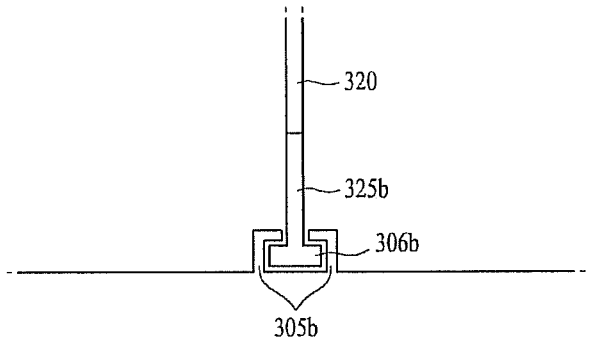

FIGS. 11 and 12 are top views of couplers 305 of the basket 315 and partition plate 320. The basket 315 may include first couplers 305*a* and 305*b* respectively provided at an inner surface of the basket 315, at opposite ends of the basket 315. The first couplers 305*a* and 305*b* may have a protrusion shape, as does the first coupler 305*a*, or a groove shape, as does the first coupler 305*b*. The partition plate 320 may include second couplers 325*a* and 325*b* provided at opposite ends of the partition plate 320, to be coupled with the first couplers 305*a* and 305*b*, respectively.

In the illustrated embodiment, the first couplers 305*a* and 305*b* are integrated at opposite sides of the basket 315, respectively. The second couplers 325*a* and 325*b* are made of a material, such as plastic, which is not deformable, separately from the flexible portion of the partition plate 320. Thus, the second couplers 325*a* and 325*b* may be stably coupled with the first couplers 305*a* and 305*b*, respectively.

As shown in FIG. 11, the first couplers 305*a* and 305*b* may have a protrusion shape as shown in FIG. 11 or a groove shape as shown in FIG. 12. The second couplers 325*a* and 325*b* may have a groove shape as shown in FIG. 11 or protrusion shape as shown in FIG. 12, corresponding to the shape of the first couplers 305*a* and 305*b*.

Referring to FIGS. 11 and 12, the second couplers 325*a* and 325*b* may slide downward from the top of the first couplers 305*a* and 305*b* to be respectively coupled with the first couplers 305*a* and 305*b*.

In this case, the first coupler 305*a* of FIG. 11 and the second coupler 325*b* of FIG. 12, which have a protrusion shape, may have engagement protrusions 306*a* and 306*b* at respective ends thereof. The engagement protrusions 306*a* and 306*b* may maintain coupling thereof with the grooves 325*a* and 305*b* without being separated from the grooves 325*a* and 305*b*, respectively, even when force is laterally applied thereto. As shown in FIG. 11, the groove shape of the second coupler 325*a* may be wider at an inside thereof than at an entrance thereof, to correspond to the shape of the engagement protrusion 306*a*. As shown in FIG. 12, the first coupler 305*b* may also be wider at an inside thereof than at an entrance thereof, to receive the engagement protrusion 306*b* of the second coupler 325*b*.

Figure 13:
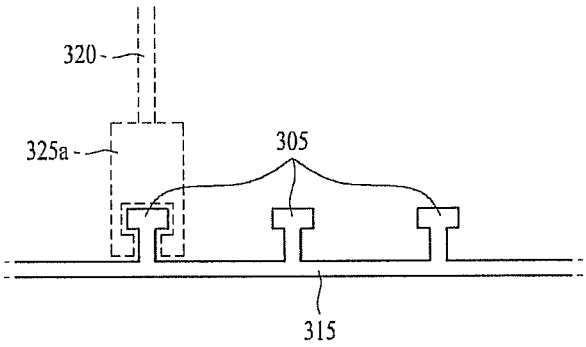

As shown in FIG. 13, a plurality of first couplers 305*a* and 305*b* may be provided, spaced apart from one another by a certain distance, at a given end of the basket 315 so as to change the coupling position of the partition plate 320, if necessary. The first couplers 305*a* and 305*b* may be formed at opposite end surfaces of the basket 315, respectively, such that the partition plate 320 may be arranged in parallel with the door 20. To arrange the partition plate 320 in a direction perpendicular to the door 20, the first couplers 305*a* and 305*b* may instead be formed at front and rear surfaces of the basket 315, respectively.

In a refrigerator having a door structure and baskets as embodied and broadly described herein, an outer one of a pair of baskets may be pivotally opened by hinges to easily access items stored in an inner basket, enhancing utility of the inner basket.

Storage areas of the baskets may be easily accessed by simply separating the baskets. The separated baskets may be subsequently stably coupled to the refrigerator. Thus, utility of the baskets attached to the refrigerator door may be enhanced.

In a refrigerator as embodied and broadly described herein, movement of items stored in a basket attached to the door as the door is opened and closed may be prevented, and items of various sizes may be stored therein due to a flexible partition plate provided at the basket. Thus, utility of the basket attached to the refrigerator door may be enhanced.

A refrigerator is provided that is capable of providing easy access to an inner one of a plurality of baskets, which are arranged in horizontally-overlapping double layers, thereby achieving an enhancement in utility of the baskets.

A refrigerator is provided which includes a basket having a structure enabling stable fixing of the basket to a refrigerator door while achieving easy mounting and separation of the basket, to achieve an enhancement in utility of the basket.

A refrigerator is provided which includes a basket partition plate changeable in terms of mounting position and shape in accordance with the shape of a food article to be stored, to achieve an enhancement in utility of baskets provided at a refrigerator door.

A refrigerator as embodied and broadly described herein may include a case provided with a storage space while being opened at one side thereof; a door pivotally coupled, at one end thereof, to the case by hinges such that the door pivots to open or close the opened side of the case; a basket frame pivotally coupled, at one end thereof, to an inner surface of the door such that the basket frame pivots; a first basket coupled to the basket frame; and a second basket coupled to the inner surface of the door while being interposed between inner surface of the door and the first basket.

A refrigerator as embodied and broadly described herein may include a case provided with a storage space while being opened at one side thereof, a door pivotally coupled, at one end thereof, to the case by hinges such that the door pivots to open or close the opened side of the case, a basket frame pivotally coupled, at one end thereof, to an inner surface of the door such that the basket frame pivots, a first basket coupled to the basket frame such that the first basket opposes the door, and a second basket coupled to the inner surface of the door while being interposed between the door and the basket frame.

The refrigerator may also include a locker mounted to the other end of the basket frame, to lock the basket frame in a state of being fixed to the door.

The locker may include a lever pivotally coupled, at one end thereof, to the basket frame by a hinge such that the lever pivots about the hinge, and a hook coupled, at one end thereof, to the lever such that the other end of the lever is engaged with or disengaged from the door in accordance with the pivotal movement of the lever.

The hook may move through the basket frame in accordance with the pivotal movement of the lever.

The refrigerator may also include a first door rack extending from the basket frame in a direction opposite to the door. The first basket may be separably coupled to an upper surface of the first door rack.

The refrigerator may also include a holder for preventing the first basket from being separated from the first door rack.

The holder may also include a first protrusion/groove structure formed at a lower surface of a bottom of the first basket, and a second protrusion/groove structure formed at the upper surface of the first door rack, to be engaged with the first protrusion/groove structure.

The holder may include a first magnet provided at a lower surface of a bottom of the first basket, and a second magnet provided at the upper surface of the first door rack, to be coupled with the first magnet in accordance with attractive force of the first magnet.

The refrigerator may also include a second door rack mounted to the inner surface of the door. The second basket may be separably coupled to an upper surface of the second door rack.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a case having a storage space that is open at one side of the case;

a door rotatably coupled to the case to open and close the opened side of the storage space;

a basket frame having a first vertical frame part and a second vertical frame part, wherein the first vertical frame part is rotatably coupled to an inner surface of the door to rotate toward the door in a closed position or away from the door in an open position;

each of the first and second vertical frame parts comprise at first surface, a second surface, and a third surface; the first surface facing the door, the second surface facing away from the door and opposite to the first surface, and the third surface extending between the first and second surfaces, wherein the third surface of the first vertical frame part faces the third surfaces of the second vertical frame part, wherein the third surfaces of the first and second vertical frame parts are spaced apart by a predetermined distance forming a space between the first vertical frame part and the second vertical frame part;

at least one first basket coupled to the basket frame, the at least one first basket including four side walls;

at least two first door racks extending outward from the second surfaces of the first and second vertical frame parts in a direction away from the door and having a surface on which the at least one first basket rests;

at least one second basket having a length that fits in the space, wherein the length is a longest side of all sides of the second basket; and the second basket is coupled to the inner surface of the door and positioned between the inner surface of the door, the third surfaces of the first and second vertical frame parts and the at least one first basket when the basket frame is in the closed position;

at least one panel extending from a rear surface of the door and in the direction away from the door, the panel comprising a surface that supports at least one of the first door racks when the frame is in the closed position, and a latch mounted at the second vertical frame part that selectively latches the second vertical frame part to the door, wherein the at least two door racks rotate away from the door together with the basket frame.

2. The refrigerator of claim 1, wherein the latch includes:

a lever having a first end of the lever pivotally coupled to the second vertical frame part; and a hook having a first end of the hook coupled to the lever such that a second end of the hook is engaged with or disengaged from the door in response to rotation of a second end of the lever about the first end of the lever.

3. The refrigerator of claim 1, further comprising:

wherein the at least one first basket is separably coupled to an upper surface of the at least one first door rack; and a holder that couples the at least one first basket and the at least one first door rack.

4. The refrigerator of claim 3, wherein the holder comprises:

at least one first protrusion and at least one first groove formed at a lower surface of a bottom of the at least one first basket; and at least one second protrusion and at least one second groove formed at the upper surface of the at least one first door rack, respectively corresponding to the at least one first groove and at least one first protrusion, so as to be engaged with the at least one first groove and at least one first protrusion.

5. The refrigerator of claim 3, wherein the holder comprises:

at least one first magnet provided at a lower surface of a bottom of the at least one first basket; and at least one second magnet provided at the upper surface of the at least one first door rack, and positioned corresponding to the at least one first magnet so as to be coupled with the at least one first magnet by an attractive force between the at least one first magnet and the at least one second magnet.

6. The refrigerator of claim 3, further comprising:

at least one second door rack coupled to the inner surface of the door, wherein the at least one second basket is separably coupled to an upper surface of the at least one second door rack.

7. The refrigerator of claim 1, wherein the at least one first basket includes a plurality of first baskets arranged vertically on the basket frame, and the at least one second basket includes a plurality of second baskets vertically arranged on the inner surface of the door, at positions respectively corresponding to the plurality of first baskets.

8. The refrigerator of claim 7, wherein a space between adjacent first baskets bounded by the basket frame is open to provide access to corresponding second baskets when the door frame is closed against the door.

9. The refrigerator of claim 1, wherein the storage space is partitioned into a refrigerating chamber and a freezing chamber the door includes a refrigerating chamber door and a freezing chamber door, and wherein the basket frame, the at least one first basket and the at least one second basket are provided on the refrigerating chamber door.

10. A refrigerator, comprising:

a case defining a storage space that is open at one side of the case;

a door rotatably coupled to the case to open and close the opened side of the storage space;

a basket frame having a first vertical frame part and a second vertical frame part, wherein the first vertical frame part is rotatably coupled to an inner surface of the door to rotate toward the door in a closed position or away from the door in an open position;

each of the first and second vertical frame parts comprise at first surface, a second surface, and a third surface; the first surface facing the door, the second surface facing away from the door and opposite to the first surface, and the third surface extending between the first and second surfaces, wherein the third surface of the first vertical frame part faces the third surfaces of the second vertical frame part, wherein the third surfaces of the first and second vertical frame parts are spaced apart by a predetermined distance forming a space between the first vertical frame part and the second vertical frame part;

a plurality of first baskets coupled to the basket frame, the plurality of first baskets including four side walls;

a plurality of first door racks extending outward from the second surfaces of the first and second vertical frame parts in a direction away from the door and each of the first door racks has a surface on which a corresponding first basket of the plurality of first baskets rests;

a plurality of second baskets, each of the second baskets having a length that fits in the space, wherein the length is a longest side of all sides of the second basket; and the plurality of the second basket are coupled to the inner surface of the door and positioned between the door, the third surfaces of the first and second vertical frame parts and the basket frame when the basket frame is in the closed position;

at least one panel extending from a rear surface of the door and in the direction away from the door, the panel comprising a surface that supports at least one of the first door racks of the plurality of first door racks, when the frame is in the closed position, and a latch mounted at the second vertical frame part that selectively latches the second vertical frame part to the door to place the frame in the closed position;

wherein, the closed position corresponds to a first position, in which the basket frame is closed against the inner surface of the door, with the plurality of second baskets positioned between the door and the plurality of first baskets, and wherein, in the first position, an interior of the plurality of second baskets is accessible via open spaces between adjacent first baskets arranged on the basket frame, wherein the plurality of first door racks rotate away from the door together with the basket frame.

11. The refrigerator of claim 10, wherein, in a second position the basket frame is rotated away from the door to fully expose the plurality of second baskets coupled to the inner surface of the door.

12. The refrigerator of claim 10, wherein the latch includes:

a lever having a first end pivotally coupled to the second vertical frame part; and a hook coupled having a first end coupled to the lever such that a second end of the hook is engaged with or disengaged from the door in response to rotation of the lever.

13. The refrigerator of claim 10, further comprising:

a plurality of first door racks each extending from the basket frame in a direction away from the door, wherein the plurality of first basket are respectively coupled to upper surfaces of the plurality of first door racks; and a holder that couples each first basket to its respective first door rack.

14. The refrigerator of claim 13, wherein the holder comprises:

first protrusion/groove structure formed at a lower surface of a bottom of each first basket; and a second protrusion/groove structure formed at the upper surface of each first door rack, to be engaged with the first protrusion/groove structure.

15. The refrigerator of claim 13, wherein the holder comprises:

a first magnet provided at a lower surface of a bottom of each first basket; and a second magnet provided at the upper surface of each first door rack, to be coupled with respective first magnet by an attractive force between the respective second magnet and the corresponding first magnet.

16. The refrigerator of claim 13, further comprising:

a plurality of second door racks mounted to the inner surface of the door, wherein the plurality of second baskets are respectively coupled to an upper surface of the plurality of second door racks.

* * * * *